United States Patent [19]

Dritt et al.

[11] 4,005,233

[45] Jan. 25, 1977

[54] FILAMENT WOUND STRUCTURE AND METHOD

[75] Inventors: William S. Dritt, Oak Ridge; Howard L. Gerth, Knoxville; Charles E. Knight, Jr., Knoxville; Robert M. Pardue, Knoxville, all of Tenn.

[73] Assignee: The United States of America as represented by the United States Energy Research and Development Administration, Washington, D.C.

[22] Filed: Oct. 30, 1975

[21] Appl. No.: 627,394

[52] U.S. Cl. ..... 428/35; 156/170; 156/186; 220/3; 220/83; 242/2; 242/3; 242/7.21; 242/7.23; 428/294

[51] Int. Cl.[2] ..... B65D 7/42

[58] Field of Search ..... 156/170, 186; 220/3, 220/83; 242/2, 3, 7.23, 7.21; 428/294, 35

[56] References Cited

UNITED STATES PATENTS

| | | | |
|---|---|---|---|
| 2,788,836 | 4/1957 | Trevaskis et al. | 156/170 |
| 2,966,935 | 1/1961 | Wiltshire | 220/83 |
| 3,047,191 | 7/1962 | Young | 220/83 |
| 3,112,234 | 11/1963 | Krupp | 242/2 |
| 3,279,796 | 10/1966 | Holman | 220/83 |
| 3,333,778 | 8/1967 | Levenetz et al. | 242/3 |
| 3,411,727 | 11/1968 | Uhlig et al. | 220/83 |
| 3,449,182 | 6/1969 | Wiltshire | 220/83 |
| 3,486,655 | 10/1969 | Ragettli | 220/3 |
| 3,655,085 | 4/1972 | Aleck | 220/83 |

*Primary Examiner*—Marion E. McCamish
*Attorney, Agent, or Firm*—Dean E. Carlson; David S. Zachry; Earl L. Larcher

[57] ABSTRACT

The present invention relates to a filament wound spherical structure comprising a plurality of filament band sets disposed about the surface of a mandrel with each band of each set formed of a continuous filament circumferentially wound about the mandrel a selected number of circuits and with each circuit of filament being wound parallel to and contiguous with an immediate previously wound circuit. Each filament band in each band set is wound at the same helix angle from the axis of revolution of the mandrel and all of the bands of each set are uniformly distributed about the mandrel circumference. The pole-to-equator wall thickness taper associated with each band set, as several contiguous band sets are wound about the mandrel starting at the poles, is accumulative as the band sets are nested to provide a complete filament wound sphere of essentially uniform thickness.

10 Claims, 8 Drawing Figures

FILAMENT WOUND STRUCTURE AND METHOD

Figure 1:
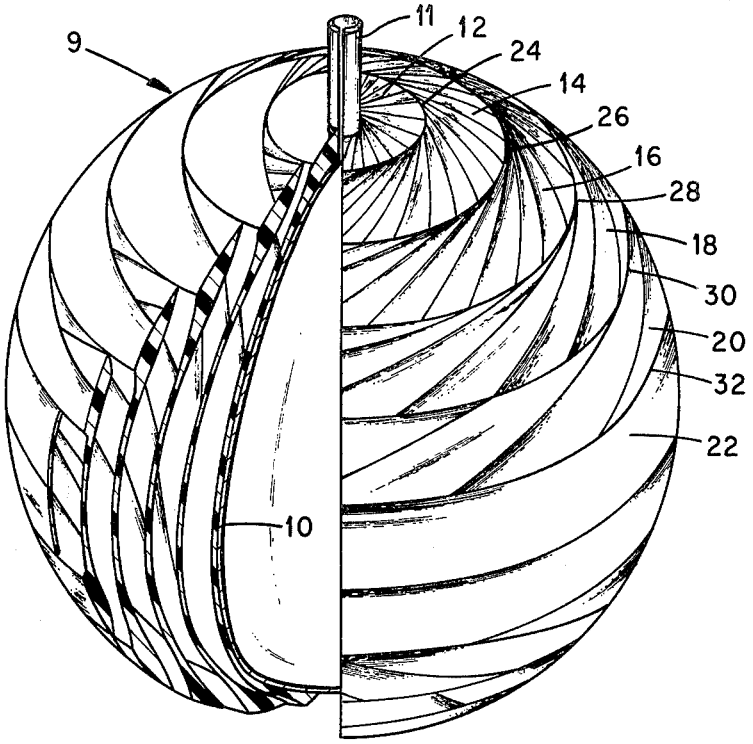

This invention was made in the course of, or under, a contract with the Energy Research and Development Administration.

The present invention relates generally to a spherical filament wound pressure vessel having a fill tube projecting therefrom and, more particularly, to the fabrication of such a vessel wherein the vessel possesses substantially uniform wall thicknesses, and significantly increased rupture strength over previously wound filament vessels of essentially the same dimensions, material, and weight.

The containment of fluids under high pressure requires the use of a pressure vessel having sufficient structural integrity to resist bursting or deleterious leakage. The fabrication of pressure vessels possessing adequate strength characteristics may be conveniently formed of metal. However, for some applications, such as the storage of pressurized fluids used in aircraft or aerospace applications the weight and size of metal pressure vessels may be excessive. Filament wound pressure vessels have been found to provide a satisfactory solution to the weight and size disadvantages suffered by vessels of metal construction since the filament wound vessels are of relatively light weight, possess high strength-to-weight ratios, and can be produced with predictable burst strengths. In general, filament wound structures are prepared by winding a fibrous reinforcement material which may be in the form of continuous filament, wires or tapes onto a suitably shaped mandrel. The successive circuits of reinforcement are usually bound together with a resinous matrix material which may be preimpregnated, impregnated during winding, or post-impregnated into the fibrous reinforcement material to form a high-strength composite structure. The respective types of reinforcement material and matrix materials may be varied in accordance with the application envisioned of the fiber wound structure.

A pressure vessel of a spherical configuration is the most efficient shape for providing the maximum volume for a minimum surface area. The manufacture of spherical filament wound pressure vessels requires several important considerations. For example, there must be a fill tube projecting into the vessel to make it useful, with the fill tube being well anchored within the filamentary material so as to minimize the possibility of it being deleteriously displaced when the vessel is pressurized. Usually, relatively small diameter fill tubes can be adequately anchored within the filamentary material. There must also be a spherical mandrel upon which the filamentary material is wound. Often this mandrel is provided by a bladder which is leak-tight and forms part of the pressure vessel. Important consideration must be given to the control of the filament winding patterns upon the surface of the mandrel or bladder so as to prevent damage to fill tube.

Helical winding techniques have been employed in the manufacture of structures such as pressure vessels which have the shape of closed surfaces of revolution. In such previous winding techniques, the winding of the filamentary material is generally initiated on the mandrel at one pole thereof as defined by the axis of revolution of the mandrel and with the winding wrapped about the circumference of the mandrel along a path forming an acute angle with the axis thereof. The filament laydown or winding continues past the opposite pole and returns on the opposite side of the mandrel forming the same helix angle with the mandrel axis. The mandrel and machine slides holding the filament payout are concurrently moved through prescribed motions during the filament laydown for generating the helical path. The machine controls are set such that when a helical circuit is complete the path is offset by the desired lead rate, with the winding being continued circuit-by-circuit until full coverage of the mandrel is achieved with the number of circuits being determined by the designated lead rate. It has been found that the helical pattern of filaments results in multiple crossovers of wound filament material and excessive material thickness in the polar areas for the desired filament coverage in the equatorial areas of the mandrel. To minimize these problems, multiple helical winding patterns have been employed to fabricate spherical pressure vessels, but only limited success has been achieved in solving the problem due to the excessive filament thickness at the polar areas. Further, the presence of the filamentary crossovers results in a considerable volume of voids or interstices between contiguous filaments so as to considerably detract from the strength of the winding for a given thickness. Also, these interstices are not of uniform size or evenly spaced about the surface of the sphere so as to present areas of relative weakness. Additionally, the fabricaton of spherical vessels from helically wound filament strands which have unidirectional properties results in a considerable reduction in the working stress of a pressured vessel below the maximum stress allowable in a structure formed of only parallel unidirectional strands of filamentary material.

Another well-known technique for fabricating filament wound spherical structures is to wind the mandrel with a completely random winding pattern with each strand or band of filamentary material traversing the sphere in a direction different from every other strand. However, with a fill tube projecting from the surface of the pressure vessel it is highly impractical to randomly wind spherical pressure vessels since the fill tube must be protected from possible damage during the winding operation. This protection is normally afforded by placing the fill tube on the axis of rotation provided by a rotatable spindle or chuck mechanism, which requires that the fill tube be affixed in a chuck so that the fill tube provides all the structural support during the winding operation. Further, filament wound pressure vessels formed by rotating the sphere on a single axis provided by the fill tube when pressurized to failure expanded about twice as far in the polar regions as in the equatorial regions. Also, like the above-mentioned helical winding pattern, the many fiber crossovers resulting from random winding techniques causes an undesirable low fiber concentration as well as a high void content.

Accordingly, the primary aim or goal of the present invention is to substantially minimize or obviate problems previously encountered with the fabrication of pressure vessels by filament winding techniques, especially with respect to the problems caused by excessive polar thicknesses of the filamentary material, relatively low composite fiber content, and high content of voids or interstices due to excessive fiber crossovers. The aim or goal of the present invention is achieved with the fabrication of a filament wound structure characterized by a plurality of filament band sets disposed about the surface of a spherical mandrel with each band in each set being formed of a continuous filament circumferentially wound about the mandrel in a predetermined number of circuits, with each circuit of filament about the mandrel being along a plane parallel to and contiguous with the immediate previously wound circuit of filament. The filament bands of each band set, except for the band set at the equator of the sphere, are disposed in an overlapping arrangement at a longitude nearest the poles of the sphere and in a substantially side-by-side relationship at the equator of the sphere with the number of bands forming each set being equal to the number of bands required to cover the mandrel at the equator thereof. Exposed portions of each set of bands disposed nearest the poles of the sphere are arranged in a side-by-side relationship with adjacent exposed portions of each set of bands so that the thickness of these exposed portions plus any portions of any other set or sets of bands underlying the exposed portions is essentially uniform between the poles and the equator of the sphere.

Other and further objects of the invention will be obvious upon an understanding of the illustrative embodiment and method about to be described, or will be indicated in the appended claims, and various advantages not referred to herein will occur to one skilled in the art upon employment of the invention in practice.

An embodiment of the invention has been chosen for the purpose of illustration and description. The embodiment illustrated is not intended to be exhaustive or to limit the invention to the precise form or method disclosed. It is chosen and described in order to best explain the principles of the invention and their application in practical use to thereby enable others skilled in the art to best utilize the invention in various embodiments and modifications as are best adapted to the particular use contemplated. For example, while the pressure vessel shown in the drawings is illustrated as having six sets of bands, it is to be understood that any number of band sets may be used to practice the present invention. Further, the composition of the filamentary material used to form the monofilament, yarn, or rovings used as the windings does not form part of the invention, and can be any material, such as glass, carbon, boron or other materials in filamentary form, found suitable for the construction of the spherical pressure vessel. Also, the composition of the impregnant which forms the matrix for the winding may be a resin, such as epoxy or the like, but the particular impregnant is not a critical feature of the invention and can be any suitable, well-known, commercially available, matrix-forming material.

Figure 2:
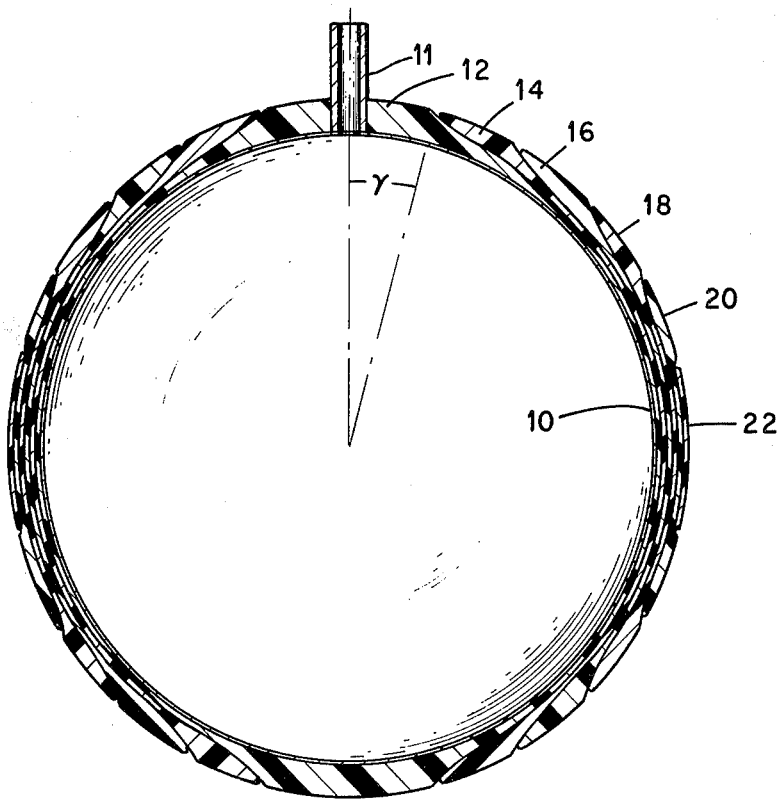

In the accompanying drawings:

FIG. 1 is a partially broken away illustration of a filament wound spherical pressure vessel constructed in accordance with the teachings of the present invention;

FIG. 2 is a sectional view of a pressure vessel as in FIG. 1 showing further details of the winding technique of the present invention; and FIGS. 3–8 are illustrations showing the progressive stages of winding required for preparing the pressure vessel as shown in FIGS. 1 and 2. In FIGS. 3–8, the mandrel and the underlying filament band sets are removed for the purpose of illustration and description.

Described generally, the present invention is directed to an improved filament wound spherical structure having at least one fill tube projecting from the surface thereof. To fabricate this structure, an orbicular mandrel is wrapped with continuous filament laid in parallel paths about the great circle of the mandrel in the form of a band. Additional bands of filamentary material are then sequentially applied to the mandrel surface by indexing the mandrel on its rotational or polar axis a prescribed angular distance between each band so as to provide a band set which covers a selected surface area. Each band set is wound in such a manner that the thicknesses thereof decreases from a location thereon nearest the poles of the sphere towards the equator of the sphere. Also the surface area covered by each band set decreases from pole to equator and the band sets are sequenced in the amount of surface area covered so that the decreasing wall thicknesses of the band sets fit together in a complimentary manner to produce a contoured wall thickness of symmetrically wound filaments about one axis. The mandrel is wound with a plurality of band sets with each band set being disposed along circumferential paths which cross the mandrel axis of rotation at prescribed angles so as to sequence the amount of surface area covered by each band set and thereby fitting the tapered wall thicknesses of the entire plurality of band sets to provide a substantially uniformly thick structure of essentially uniform tensile stress and strength for achieving improved bursting strengths over previously known pressure vessels.

Referring to FIGS. 1 and 2, the winding pattern of the present invention provides a uniform distribution of fiber orientation and uniform total thickness over essentially the entire surface of the mandrel. This winding pattern may be referred to as a "delta-axisymmetric" pattern since sets of bands of filamentary material are applied equally spaced around the winding or symmetry axis, for yielding an incremently symmetric pattern. The basic winding pattern may be defined by considering the geometry of a sphere 9 having a spherical mandrel 10 of any suitable metal or elastomeric material and a fill tube 11 projecting from the mandrel. In these Figs., numerals 12, 14, 16, 18, 20, and 22 are directed to band sets of filamentary material while the lines indicated by numerals 24, 26, 28, 30, and 32 represent edges between the band sets. As previously mentioned above, sets of filament bands are applied to the mandrel with each band of each set being generated by circumferentially winding suitable filamentary material along parallel paths on both sides of the great circle. The band is actually wound by starting at a specified location on the band edge of one side of the great circle nearest the poles of the mandrel and circumferentially winding the filamentary material about the mandrel at a desired lead rate until the desired width of the parallel filament band is established.

The basic winding pattern is dictated by the requirement for the total coverage of the mandrel surface with the desired thickness of filamentary material which may require several bands depending upon expected use and filamentary material used. The thickness of a single filament band may be found experimentally for a given fiber-resin system and set of winding conditions. The designed total thickness of filamentary material at the equator is two times the band thickness since each band yields two layers of coverage at the equator. For example, if the required thickness of filamentary material is 3.00 mm and the band thickness is 0.25 mm, then the number of band sets required for such coverage is $3/(2 \times 0.25) = 6$. The band sets are applied in an equally spaced manner along the meridian (longitude) of the mandrel from the pole to the equator thereof.

The band width is, in turn, equal to the band spacing on the surface along the meridian, thus when equally spaced along the meridian the band width in this example has a 15° (90/6) intercept on the surface. The number of bands in each set is calculated to give complete coverage of the mandrel in a side-by-side band placement at the equator. The filament bands cross the equator of the mandrel at an angle related to their position along the meridian. The first band set is wound so that in the north hemisphere one edge of each band in the set is tangent to the polar axis of the mandrel with the opposite edge of each band set lying on a latitude circle at a position along the meridian one band width away. In the south hemisphere the roles of the respective band edges are reversed. The central plane of each filament band is on a great circle of the mandrel at an angle ($\gamma$) with the polar axis, which angle is equal to one-half the band width intercept angle on the sphere surface. The angle between the equator and the central plane of the band is ($\pi/2-\gamma$). The number of bands in this particular band set is then equal to the equator circumference divided by the coverage of one band. For example, where $\gamma$ is equal to 7.5°, the equator coverage of one band is 15° band width divided by the cosine of 7.5°, and thus the number of bands required for the first band set is 24 since only an integer number of bands may be applied. The second set of bands, such as at 14, is then applied with one edge tangent to the latitude circle of the first band set and the other edge of each band lying on a latitude circle again one band width further away from the poles. This second band set 14 were $\gamma$ is equal to 22.5° requires 22 bands to cover the mandrel at the equator. Similarly, successive band sets are applied progressively along the meridian to the equator. Whereas, upon completion, the basic pattern of the present invention provides 100% coverage of the mandrel with a filament winding which is of essentially uniform thickness, e.g., a thickness variation of ±10 mils over the entire sphere having a winding thickness of 0.200 inch.

The delta-axisymmetric winding pattern of the present invention, as described above, is best defined for a pure sphere which has no discontinuity due to the presence of one or more fill tubes. It may be readily shown from engineering mechanics that the ideal filament wound pattern for a sphere is one which has constant wall thickness and a constant strength level in all directions at all points on the spherical surface. It may be further shown that this pattern may be achieved with a basic delta-axisymmetric winding pattern. A band of filamentary material is the basic unit of the delta-axisymmetric pattern with the bands being produced by circumferentially winding a filament of a suitable material in a parallel continuous circuit on a spherical mandrel. The circuits of filament material lie on the great circle of the sphere and on each side of the great circle in essentially parallel planes. The circumferential winding with a lead rate corresponding to the filament laydown width produces a band of filamentary material with an appearance of an endless belt around the great circle of a sphere. The band width corresponds to an angular arc intercept coverage on the sphere surface with all band widths of a basic delta-axisymmetric pattern being of the same width.

However, in actual practice at least one fill tube is required for utilization of the filament wound structure as a pressure vessel. With a fill tube projecting through the surface of the mandrel 9, such as fill tube 11, the latter is placed concentric with the poles or axis of revolution of the mandrel. With a fill tube present an adjustment to the winding pattern must be made to allow for the fill tube discontinuity. Such adjustment in the winding pattern may be made in any several ways. For example, in a case of only a single fill tube, the entire pattern may be shifted along the meridian of the mandrel towards the equator so that the edge of the first filamentary band set is tangent to the fill tube while the pattern in the opposite hemisphere contiguous to the other pole is positioned as for an ideal delta-axisymmetric winding pattern; i.e., no fill tube discontinuity.

Another technique of adjusting the winding pattern may be to reduce the width of the first band set by the amount of angular fill tube arc intercept and increasing the number of bands to give full coverage at the equator. In this case, the remainder of the band sets on the fill tube hemisphere of the mandrel may then be placed in an ideal delta-axisymmetric winding pattern position. On the opposite hemisphere, the first band set edges is tangent to the polar axis while the remainder of the band sets are shifted towards the rotational axis so as to be contiguous along the meridian. Alternatively, the band sets, after applying the first band set, may be positioned in their ideal pattern position with a space remaining between the first and second band sets along the meridian, or the space may be divided into smaller increments to be, in turn, divided between two or more remaining band sets.

A further winding variation may be the use of small bands as reinforcing bands, with these bands having a width equal to the fill tube angular arc intercept. These reinforcing bands may be positioned tangent to the fill tube and in a space between the first and second band sets on the side of the mandrel opposite the fill tube. The reinforcing bands serve to strengthen the filament-wound composite around the fill tube and balance the stress concentration due to the fill tube discontinuity.

A still further winding variation is to alternate the successively wound bands in the first band set 180° apart from one another so as to minimize voids in the winding near the fill tube due to an overlapping or "staircase" effect which may be present when the bands are applied sequentially in a single direction.

Generally, any departure from an ideal winding pattern may result in an increased or decreased winding thickness in the polar area depending upon the mandrel geometry, the filamentary material and the winding pattern parameters selected.

Figure 3:
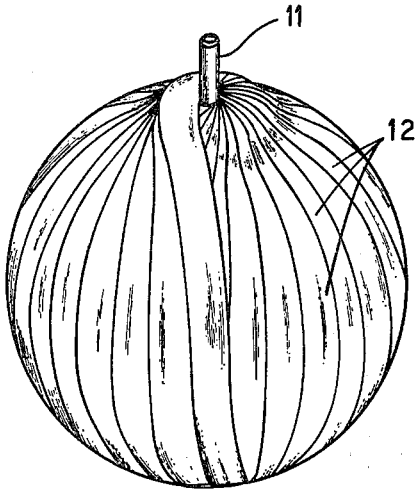

As shown in FIGS. 3–8, a spherical pressure vessel with a fill tube 11 (FIG. 3) may be constructed by the steps of winding a continuous filament circumferentially about a spherical mandrel. The circumferential path of the filamentary material lies in a plane which crosses equator of the mandrel and forms an angle (helix angle) with the poles or axis of rotation of the mandrel. The specified number of continuous filament circuits wound at a specified lead rate along parallel paths are used to form a band of filamentary material. The mandrel is then incremently rotated on its polar or rotational axis to a specified angle where a second band is wound at the same helix angle as the first band. Subsequent bands in the band set are then applied sequentially with the band set 12 being completed upon one revolution of the mandrel, as shown in FIG. 3. The number of filament circuits in each band is preferably the same for all bands in a set.

Figure 4:
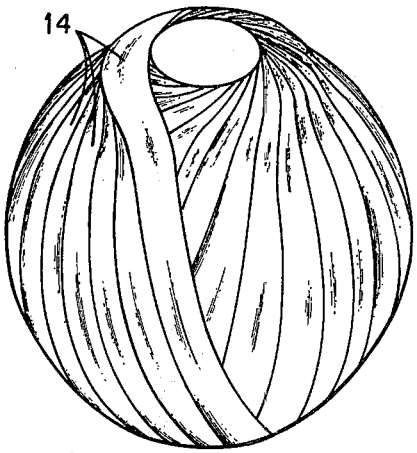
Figure 5:
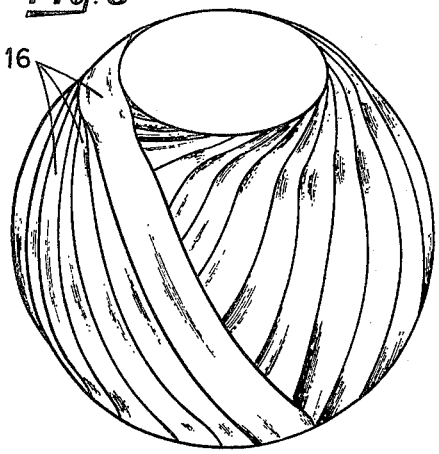
Figure 6:
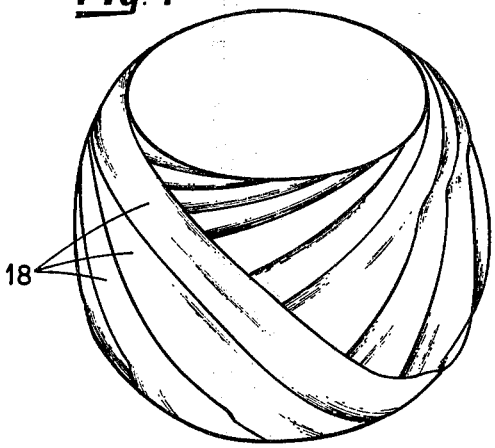
Figure 7:
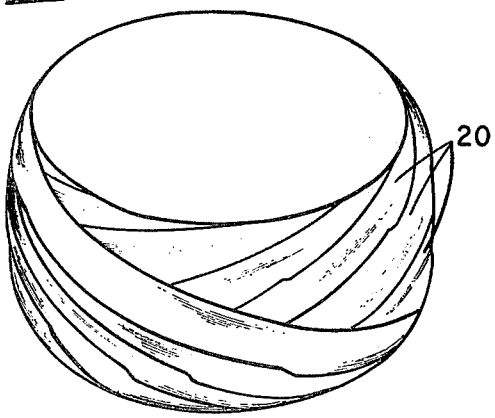
Figure 8:
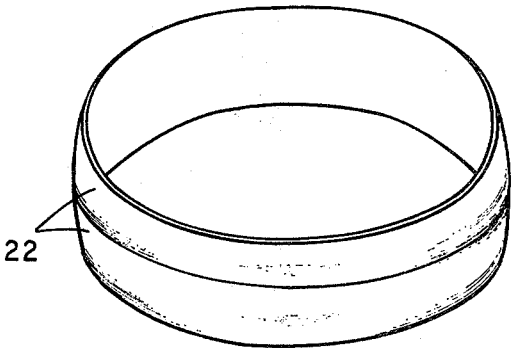

In FIG. 4 the mandrel is positioned for the second set of bands by changing the helix angle between the mandrel axis and the filament laydown plane. The filament bands in the second set 14 are then wound in a manner similar to those in the first band set 12. All bands in the second set are applied when one revolution of the mandrel is completed.

As shown in FIGS. 5–8, additional band sets 16, 18, 20, and 22 are formed in the same manner as band sets 12 and 14 until the mandrel is completely covered by a shell of the filamentary material, forming the delta-axisymmetric winding pattern of the present invention.

If found necessary to bring the filament winding to the desired thickness, additional shells of filament band sets may be applied over the first layer or shell of band sets by simply repeating or reversing the sequence of winding as previously described. The combination of the first shell and a reversed pattern second shell provides a structurally balanced construction. Any number of shells may be wound upon the pressure vessel to provide the desired thickness. It may be preferable to alternate the winding sequence with each successive shell to assure structural balanced coverage of the mandrel.

In order to provide a more facile understanding of the present invention, examples relating to typical winding operations in accordance with the present invention are set forth below:

EXAMPLE I

A filament wound spherical pressure vessel was provided by employing an aluminum mandrel having a wall thickness of 0.08 inch with a diameter of 8 inches and a single fill tube having a diameter of 0.25 inch. The table below sets forth parameters which were used to wind the filamentary material about the spherical mandrel. The filamentary material employed in this Example was a single end glass yarn, which was passed through a conventional impregnation device during the winding of the band sets so as to impregnate the yard with epoxy resin. The band lead rate was 0.01 inch and the part was completed with two shells (nine band sets in each shell) in a balanced construction. The total wall thickness of the lining was uniform over virtually the entire sphere with a thickness buildup in the fill tube area of approximately 25 percent which increased the rupture strength at a heretofore weak point. The average wall thickness of the filamentary material was 0.18 inch with an average filament content of 88 weight percent. The wound vessel had a burst pressure strength of 14,100 psi, a membrane wall strength of 160,000 psi and a strength-to-weight efficiency of 1.40 $\times 10^6$ inch. The efficiency is a measure of the overall strength-to-weight ratio of the filamentary material in the filament wound spherical pressure vessel configuration and is calculated by the formula: Efficiency = $PV/W$, where $P$ equals burst pressure, $V$ equals contained volume, and $W$ equals weight of the vessel.

TABLE

| Helix Angle | No. of Circuits/Band | No. of Bands In Each Set |
|---|---|---|
| 5.9 | 69 | 36 |
| 6.9 | 13 | 30 |
| 18.0 | 85 | 28 |
| 30.0 | 87 | 25 |
| 42.0 | 85 | 22 |
| 54.0 | 86 | 17 |
| 66.0 | 84 | 12 |
| 78.0 | 83 | 6 |

TABLE-continued

| Helix Angle | No. of Circuits/Band | No. of Bands In Each Set |
|---|---|---|
| 90.0 | 84 | 1 |

EXAMPLE II

A spherical pressure vessel was constructed with an aluminum mandrel and winding pattern similar to that employed in Example I. The filament winding material employed in this Example was a commercially available filament known as Kevlar 49-Type III roving impregnated during winding with epoxy resin. The filament wound pressure vessel was completed with four shells of nine band sets each in a balanced construction with the second and fourth shells applied in a reversed winding sequence. The wall thickness averaged a uniform 0.296 inch with a 20 percent polar build-up. The filament content was 78 weight percent. The vessel had a burst pressure of 22,400 psi, a membrane wall strength of 157,000 psi, and a strength-to-weight efficiency of 2.08 $\times 10^6$ inch.

It will be seen that the present invention provides a considerable improvement over previously wound filament pressure vessels in which multiple sets of helical patterns of filament were wound symmetrically around the axis and which were characterized by excessive polar thickness build-up, low composite fiber content, and undesirably high composite void content due to many fiber circuit crossovers. For example, such a previously wound vessel may consist of a glass filament in an epoxy resin matrix combined to yield a structure having 75 weight percent filament and 12–15 volume percent voids. Such a vessel with an average wall thickness of 0.185 inch provides a burst pressure of 9,500 psi, a membrane wall strength of 105,000 psi, and a strength-to-weight efficiency of 0.94 $\times 10^6$ inch. Other previously known pressure vessels wound by using bands applied in randomized winding sequences and orientations to achieve uniform thickness introduced excessive fiber crossovers which resulted in relatively low fiber content and undesirably high void content. A vessel formed by random winding techniques using glass filament and an epoxy matrix with an average wall thickness of 0.18 inch and 82 weight percent fiber content had a burst pressure of 12,800 psi, a membrane wall strength of 146,000 psi, and a strength-to-weight efficiency of 1.20 $\times 10^6$ inch. Conversely, a comparison between vessels prepared by employing the subject winding pattern and vessels prepared by using previously known winding techniques as described above shows an increase in the membrane wall strength over that provided by multiple helix angle patterns and random wrapping patterns in the order of 52 and 10 percent, respectively. Also, an increase in the strength-to-weight efficiency of 49 and 17 percent, respectively, was realized. These comparisons between the present winding pattern and the previously known winding patterns relate to pressure vessels of the same geometry, sizes, and materials of construction.

what is claimed is:

1. A filament wound structure having a substantially spherical configuration comprising a mandrel, a plurality of sequentially applied filament band sets disposed axisymmetrically about the surface of said mandrel and spaced sequentially along the longitudinal plane thereof, each filament band in each filament band set being formed of a continuous filament circumferentially wound about said mandrel a predetermined number of circuits with each circuit of filament about said mandrel being along a plane parallel to and in a side-by-side abutting relationship with the immediate previously wound circuit of filament, the filament bands of each band set being disposed in an overlapping arrangement at a latitute nearest the poles of the sphere and in a substantially side-by-side relationship at the equator of the sphere except for the first and last bands being displaced radially from each other, the number of bands forming each band set being equal to the total number of bands required to cover the mandrel at the equator thereof with the bands disposed in the side-by-side relationship, and with the total thickness of the outermost set of filament bands plus any underlying segments of any other band sets being essentially uniform between the poles and the equator of said sphere.

2. A filament wound structure as claimed in claim 1, wherein each filament band of each band set is disposed on the same angle from a line projection through the poles of the sphere, and wherein the bands in each band set are uniformly spaced apart from one another about the latitude of the sphere at any given longitudinal point.

3. A filament wound structure as claimed in claim 2, wherein each filament band in each band set is formed of the same number of filament circuits.

4. A filament wound structure as claimed in claim 2, wherein said angle is different for each band set.

5. A filament wound structure as claimed in claim 1, wherein a fill tube is in registry with the interior of the mandrel and extends therefrom along a line projection through said poles.

6. A filament wound structure as claimed in claim 5, wherein said plurality of filament band sets disposed upon the mandrel forms a first filamentary shell, and wherein at least one other shell formed of a further plurality of filament band sets are disposed upon the first mentioned shell.

7. A method of fabricating a fiber-reinforced pressure vessel of spherical configuration by encasing a spherical mandrel having a fill tube projecting therefrom along a plane concentric with the polar axis of the mandrel within a plurality of sequentially applied filament band sets spaced from one another along the longitudinal plane of the mandrel with at least the majority of the band sets consisting of more than one filament band, each said filament band of each filament band set being formed by wrapping a continuous filament about the great circle of a hollow mandrel a selected number of circuits along parallel contiguous paths oriented at a selected helix angle to the polar axis of the mandrel and crossing the equator thereof with said angle being common to all of the filament bands in each filament band set, forming each of said majority of filament band sets by sequentially wrapping further filament bands in a manner similar to the first mentioned filament band with each filament band in each band set being wrapped at the same helix angle to the polar axis of the mandrel with the other bands in the same filament band set, and angularly spacing the filament bands of each band set uniform distances from one another in an overlapping relationship about the entire polar axis of the mandrel with the quantity of filament bands in each of said majority of filament band sets being adequate to cover the entire circumference of the mandrel at the equator thereof in a side-by-side relationship of the filament bands at the equator.

8. The method of fabricating a fiber-reinforced pressure vessel as claimed in claim 7, wherein each of the sequentially applied filament band sets are spaced from the poles a greater distance and are wound at a greater helix angle than the filament band set immediately previously applied.

9. The method of fabricating a fiber-reinforced pressure vessel as claimed in claim 8, including the additional step of encasing the mandrel and the said plurality of filament band sets with at least one additional plurality of filament band sets.

10. The method fabricating a fiber-reinforced pressure vessel as claimed in claim 9, wherein at least the first plurality of filament band sets of said at least one additional plurality of filament band sets is wound upon the mandrel by a winding sequence reverse to that used for winding the first mentioned plurality of filament band sets.

* * * * *